United States Patent [19]

Morse

[11] Patent Number: 4,731,009

[45] Date of Patent: Mar. 15, 1988

[54] SPRING-LOADED PLATEN ROLLERS WITH A SEALED AXLE

[75] Inventor: Milton Morse, Fort Lee, N.J.

[73] Assignee: Nena Morse, Fort Lee, N.J.

[21] Appl. No.: 914,821

[22] Filed: Oct. 8, 1986

Related U.S. Application Data

[63] Continuation-in-part of Ser. No. 786,674, Oct. 11, 1985.

[51] Int. Cl.[4] ..... B30B 15/02

[52] U.S. Cl. ..... 425/406; 100/918; 193/35 B; 384/54; 384/104; 425/411

[58] Field of Search ..... 16/97, 98, 100, 104; 29/465, 568; 100/224, 229 R, 918; 105/177; 193/35 MD, 35 B, 37; 277/136; 308/3 A, 6 R; 384/54, 58, 140, 482, 906; 414/530; 425/186, 193, 406, 411, 413, DIG. 117, DIG. 118

[56] References Cited

U.S. PATENT DOCUMENTS

| | | | |
|---|---|---|---|
| 1,381,188 | 6/1921 | Gury | 384/85 |
| 2,009,281 | 7/1935 | Stein | 384/482 |
| 2,699,366 | 1/1955 | Heinrich | 384/482 |
| 4,301,673 | 11/1981 | Yonezawa | 100/918 |
| 4,317,358 | 3/1982 | Yonezawa et al. | 100/918 |
| 4,528,903 | 7/1985 | Lerch | 100/918 |

*Primary Examiner*—Jay H. Woo

*Assistant Examiner*—J. Fortenberry

*Attorney, Agent, or Firm*—Edward R. Weingram

[57] ABSTRACT

Spring-loaded rollers for a mold have a sealed axle mount which passes through the roller into a supporting portion of the seats in the platen to prevent the roller from rotating, twisting or otherwise moving in the seat in the roller assembly and in the mold. The roller assembly is easily removed from its seat through the use of a removal device cooperating with screw threads in the roller. A plurality of rollers are used to permit a mold to be easily moved into and out of position in a press. The mold is thus mounted in position since the rollers limit the ability of the mold to move laterally. The seals are dished TEFLON disks which overfit the axle and interfit either against the sides of the roller or within slots cut circumferentially on either side of the roller. The walls of the slot may be undercut and/or otherwise shaped. The invention makes it very easy to move the heavy molds into and out of the press thereby reducing operator fatigue. The invention is keyed and grooved to keep the rollers aligned so the molds will move into proper location in the press. Wear and tear is reduced on both the molds and the platens. The axle is sealed to keep dirt out of the axle hole to prevent the rollers from siezing or jamming.

7 Claims, 16 Drawing Figures

SPRING-LOADED PLATEN ROLLERS WITH A SEALED AXLE

CROSS REFERENCE TO RELATED APPLICATIONS

This Application is a continuation-in-part of my copending application Ser. No. 786,674, filed Oct. 11, 1985 for SPRING-LOADED PLATEN ROLLERS.

BACKGROUND OF THE INVENTION

1. Field of the Invention

This invention relates to improvements and modifications in a mold-supporting arrangement in molding machines and specifically to molding machines used to mold rubber. Though disclosed in connection with the molding of rubber, the invention is applicable to the molding of other materials as well.

2. Description of the Prior Art

U.S. Pat. Nos. 4,459,909 to Takagi, 4,301,673 to Yonezawa; and 4,317,358 to Yonezawa et al, each disclose a molding press machine which includes roller arrangements to permit the molds or dies to be transported smoothly into and out of the press with a minimum of effort and a minimum of damage to the press. Applicant recognizes that in the usual rubber molding procedures, the molds are first loaded with rubber and then pushed into the molding press. The press is closed, the mold compressed, and, after curing, the press is opened and the mold withdrawn. In the larger presses, the molds are heavy and cumbersome to handle. Sliding the molds into and out of the press causes scoring, galling, and denting to the upper surface of the bottom platen of the press and to the undersurface of the mold. As disclosed in the aforementioned United States patents, the molds are more easily moved with reduced damage if load bearing units such as rollers or balls are employed as shown in the Yonezawa et al, U.S. Pat. No. 4,317,358. One of the problems associated with die-rollers which incorporate spring supported balls, is the lack of linear guidance and the consequent "drift" and "yaw" of the molds. Auxiliary guide systems which are proposed by Yonezawa et al. are complex additions to the basic invention.

As noted in my aforementioned copending application, apertures are formed in the lower platen of the press, each aperture being capable of receiving a load-bearing unit in the form of a spring-loaded roller wheel which projects approximately one-sixteenth inch above the top surface of the bottom platen of the press. Spring-loaded roller wheels are inserted into all or less than all of the apertures in the mold plate. The number of rollers used will depend upon the type of mold to be moved in and out of the press. Use of a sufficient number and pattern of the spring-loaded roller wheels enables the mold to be rolled into and out of the press across the top of the bottom platen without scratching the top surface of the bottom platen of the press or the undersurface of the mold. This therefore adds to mold life as well as the life of the platen and it reduces molder fatigue.

The load-bearing unit of my invention is formed of an axle-mounted roller-wheel where a portion of the axle extends through the roller and beyond the periphery of the axle support. This extended axle portion interfits within a portion of the aperture in the platen into which the unit is inserted so as to limit the ability of the unit to rotate in the aperture or to develop undesired play as noted by Yonezawa et al. In addition, the roller I employ does not score or engrave the mold in the undesired manner in which Yonezawa et al describe the spring-loaded ball arrangement.

My roller arrangement limits the ability of the molds to move in undesired directions as my rollers can rotate in only a forward and backward direction.

SUMMARY OF THE INVENTION

Applicant forms apertures in the lower platen of the press each aperture being capable of receiving a load-bearing unit in the form of a spring-loaded roller wheel which projects approximately one-eighth inch above the top surface of the bottom platen of the press. These spring-loaded roller wheels are inserted into all or less than all of the apertures in the mold plate. The number of rollers used will depend upon the type of mold to be moved in and out of the press. Use of a sufficient number and pattern of the spring-loaded roller wheels enables the mold to be rolled into and out of the press across the top of the bottom platen without scratching the top surface of the bottom platen of the press or the undersurface of the mold. This therefore adds to mold life as well as the life of the platen and also reduces molder-fatigue.

The load-bearing unit of applicant's invention is formed of an axle-mounted roller-wheel where a portion of the axle extends through the roller and beyond the periphery of the axle support. This extended axle portion interfits within a portion of the aperture in the platen into which the unit is inserted so as to limit the ability of the unit to rotate in the aperture or to develop undesired play as noted by Yonezawa et al. In addition, the roller employed by applicant does not score or engrave the mold in the undesired manner in which Yonezawa et al describe the spring-loaded ball arrangement.

Sealing means are provided to seal the space between the sides of the roller and the axle mounting portion thereof to inhibit dirt and grease from entering the space and clogging operation of the roller wheel by limiting its ability to rotate about its axle. These seals consist of two dished circular TEFLON disks, each having a central aperture. The aperture of each disk is interfit over the protruding portions of the axle so that the dished surface is compressed between the sides of the roller and the sides of the axle support. The dished shape of each disk serves to produce a compressive force so that a compression seal results which protects the integrity of the inner surface of the roller, the exposed distance of the axle between said roller surface and the surface of the actual mount, and a portion of the surface of the axle supports from contamination by grease and dirt.

If desired, the inner surfaces of the roller can be grooved permitting the outer portions of the TEFLON disk to ride in and be supported by the grooves to enhance the sealing effect. The slots may also be undercut to more firmly anchor the ends of the TEFLON disks and prevent collapse of the dished surface of the disks.

It is an object of the present invention to prolong the useful life of molds, and remove the necessity for regrinding the bottom platen of the press. A further object of the present invention to decrease "down time" in the molding operation due to the necessary repair and rework of the press and the molds. It is a further object of the present invention to enable more expeditious molding by providing ease in inserting and removing the mold from the press. Another object of the present invention is the provision of a mold insertion mechanism which does not require a power source or hydraulic pressure for actuation.

Another object of the present invention is the provision of a load-bearing unit incorporating a spring-loaded roller wheel which does not score or engrave the mold. Another object of the present invention is the provision of a spring-loaded wheel unit which does not develop lateral drift or "play".

Another object of the invention is the provision of a roller arrangement which limits the ability of the mold to move in undesired directions.

It is another object of the invention to provide a load-bearing unit incorporating a spring-loaded roller wheel which facilitates insertion and removal of molds from a press.

Another object of the present invention is to extend the life of the mold and/or the platens by reducing the amount of scoring or wear on the mold or platens associated with the insertion and removal of the mold.

Another object of the present invention is the provision of a spring-loaded device which can be easily removed once inserted into a platen.

A further object of the invention is to provide a roller wheel with a dished TEFLON seal so that dirt and grease cannot inhibit the rotation of the wheel.

A still further object of the invention is the provision of a flexible circular seal which is supported in and is sealed by a groove formed in the sides of the roller wheel.

It is another object of the invention to provide a load-bearing unit incorporating a spring-loaded roller wheel which facilitates insertion and removal of molds from a press which roller wheel is sealed against dirt and grease.

Yet another object of the invention is to provide a load-bearing unit incorporating a spring-loaded roller wheel which facilitates insertion and removal of molds from a press which will have superior resistance to seizing or jamming during operation.

Still another object of the invention is to provide a load-bearing unit incorporating a spring-loaded roller wheel which facilitates insertion and removal of molds from a press which will provide relatively low rolling resistance.

Another object of the invention is to provide a load-bearing unit incorporating a spring-loaded roller wheel which facilitates insertion and removal of molds from a press which will reduce the effort to move heavy molds into and out of a press.

It is another object of the invention to provide a load-bearing unit incorporating a spring-loaded roller wheel which facilitates insertion and removal of molds from a press and thereby reduces operator fatigue.

Yet another object of the invention is to provide a load-bearing unit incorporating a spring-loaded roller wheel which facilitates insertion and removal of molds from a press which is oriented and positioned so that the molds will move into the proper location in the press.

DETAILED DESCRIPTION OF THE INVENTION

Figure 1:
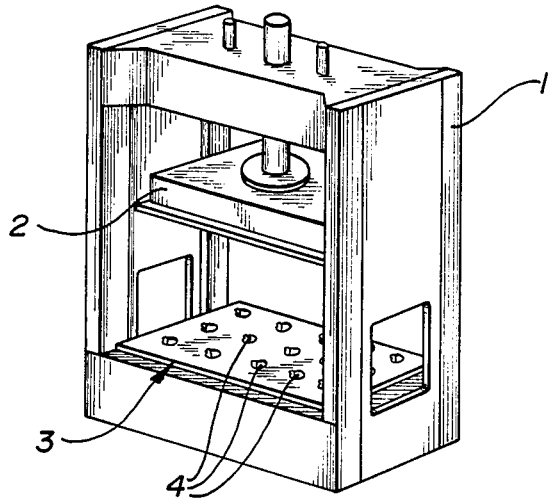
FIG. 1 is a schematic perspective view showing a press with a mold-supporting arrangement according to the invention.
Figure 2:
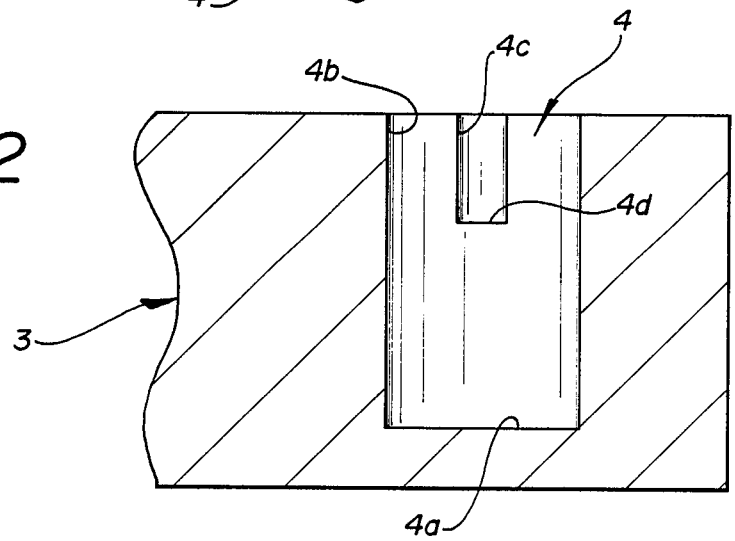
FIG. 2 is a cross section view of an aperture in the press platen.
Figure 2A:
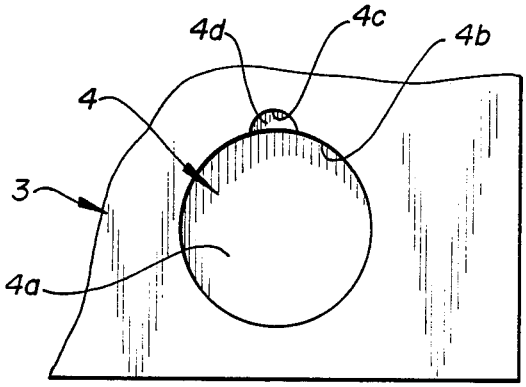
FIG. 2A is a top view of the aperture of FIG. 2.

FIG. 1 shows, generally, a molding press which incorporates a press ram 2, a machine frame 1, and a bottom platen, or bolster 3. As is known in the art, platen 3 will support a mold (not shown). Platen 3 has a plurality of spaced cylindrical seating holes 4 formed therein. As shown in FIG. 2, each of the holes 4 has a bottom wall **4*a* and a cylindrical internal wall 4*b* extending vertically from the bottom wall 4*a* to the upper surface of the platen 3. A plurality of spring-loaded roller units, as will be described hereinafter, are inserted as required in several of the apertures 4 in the bottom platen 3 in a desired pattern. The number of roller units and the pattern of placement thereof is determined in accordance with the weight and shape of the mold to be supported on platen 3. As shown in FIGS. 2 and 2A, the apertures 4 in lower platen 3 are cylindrical; however, they each have a small hemispherical section 4*c* formed therein at one side of the cylinder. Section 4*c* extends downward into platen 3 along internal wall 4*b* for approximately one-third of the depth of each cylindrical aperture 4. As will be later shown, the hemispherical section 4*c* supports a portion of the axle on which the spring-loaded roller is mounted, and also provides steadying support for the entire spring-loaded roller assembly so as to prevent same from rotating within the confines of cylindrical aperture 4**.

Figure 3:
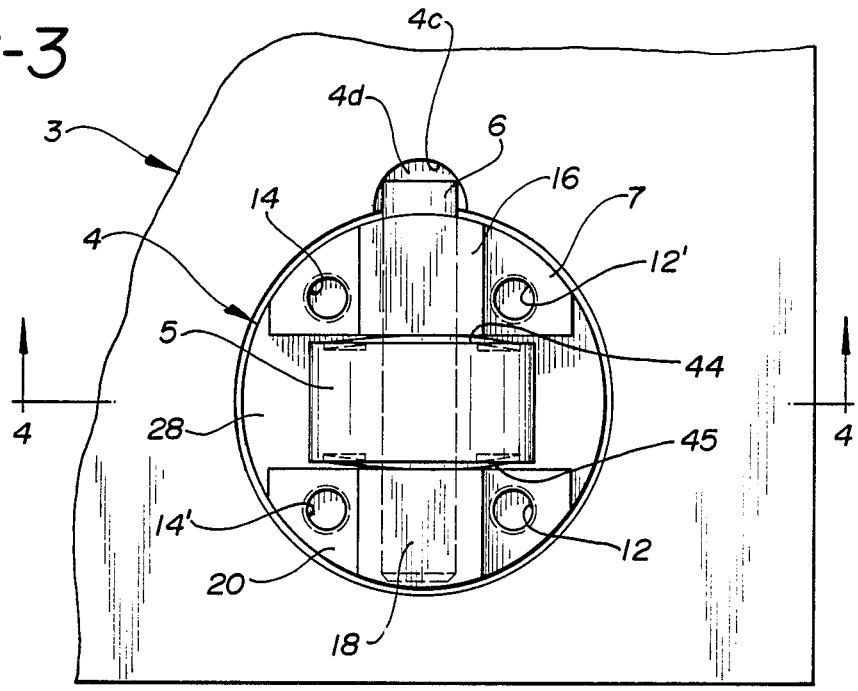
FIG. 3 is a top view of the load-bearing unit of the invention inserted into an aperture.

FIG. 3 is a top view of one of the spring-loaded roller mechanisms of the present invention as same is shown mounted in one of the cylindrical apertures 4 in platen 3. As indicated in connection with the description of FIGS. 2 and 2A above, the hemispherical portion **4*c* of aperture 4 is shown supporting a portion of axle 6 therein. As will now be understood, the location of axle 6 within and surrounded by hemispherical portion 4*c*** limits the ability of the entire assembly from rotating and thereby from causing misalignment and developing of concurrent mold drift. Two dished TEFLON seals, 44 and 45, are mounted between the sides of the roller and the walls of the axle mounts.

Numeral 5 denotes the roller which forms the main supporting part of the present invention. The roller 5 is mounted on axle 6 as shown in the section view in FIG. 4. Axle 6 is supported in axle mounts 7 and 20. These mounts each have raised portions, 16 and 18 respectively, which serve to provide strength to the entire assembly and to insure proper support of the load. Also shown in FIG. 3 are apertures 12 and 14 which are drilled into axle supports 20 and 7, respectively. These apertures are screw-threaded and provide the means by which the spring-loaded roller assembly is removed from aperture 4. Specifically, a threaded key shown generally at FIG. 5 is inserted in one or the other of the screw-threaded apertures 12 or 14, enabling the entire unit to be manually withdrawn.

Figure 4:
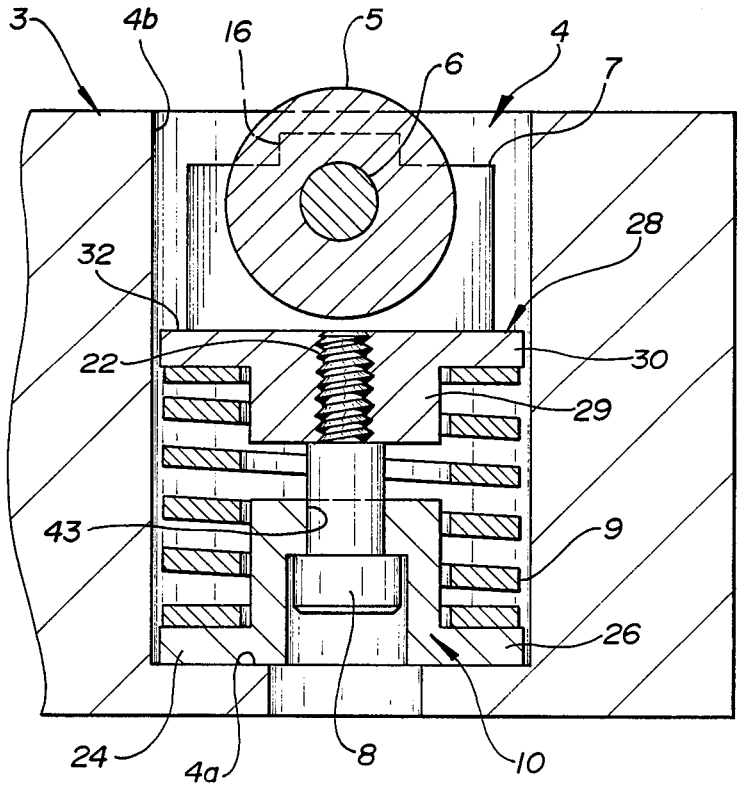
FIG. 4 is a cross sectional view, partially in section, taken along line 4—4, of the load-bearing unit of FIG. 3.

FIG. 4 is a side-view, partially sectioned, taken along the line 4—4 of FIG. 3. Numeral 5 denotes the roller which is in turn mounted for rotation on axle 6. Axle mounting supports 7 and 20 are shown having a bottom connecting portion 28 which connects and supports portions 7 and 20. A screw-threaded aperture 22 is formed at the bottom of portion 28. Aperture 22 in turn receives an assembly bolt 8 which, as will be later described, serves to compress the spring-loading feature of the present invention.

More specifically, a compression spring 9 is mounted between the connecting support 28 and a bottom support 10. Both the connecting support 28 and the bottom support 10 are cylindrical in shape and have complementary shaped legs 24, 26 for support 10 and 30, 32 for connecting support 28 formed thereon for supporting the ends of compression spring 9. As will now be apparent, assembly bolt 8 serves to hold bottom support 10 and connecting support 28 via screw-threaded aperture 22, all while placing spring 9 under compression. The entire arrangement, thus secured, is now capable of supporting a load which passes across the upper face of platen 3.

Figure 5:
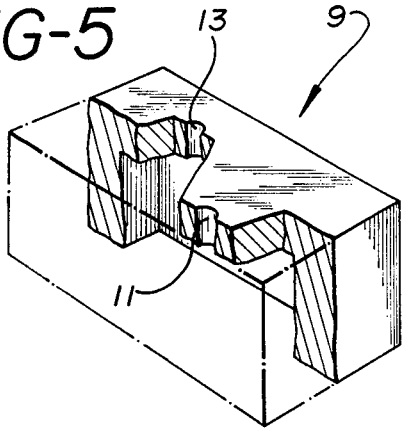
FIG. 5 is a perspective view of the cap portion of the tool used to remove the load-bearing units.

FIG. 5 shows the puller for the platen roller. The puller is used in the event the roller becomes wedged in its aperture or is otherwise difficult to remove manually because of dirt, etc. The puller fits over the roller assembly and rests on the face of the bolster 3 (FIG. 1). The puller utilizes two screws which are tightened into the roller assembly. The entire assembly is thus pulled up and out of the hole via the screws which loosen the roller assembly in its aperture. More specifically, in FIG. 5, a cap 9 has holes 11 and 13 drilled in the top surface thereof. These holes correspond in location to holes 12 and 14 in, for example, FIGS. 3 and 6. Cap 9 has an inner diameter which is slightly larger than the outer diameter of the aperture 4. The cap 9 is placed over an aperture 4 containing a spring-loaded platen roller of the invention. The outer walls of the cap rest on the bolster surface.

Figure 5A:
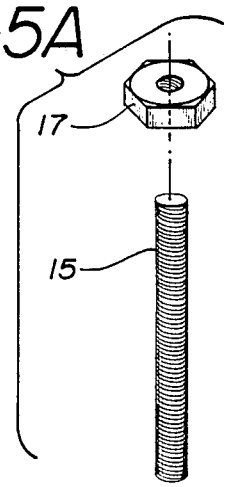
FIG. 5A is an exploded perspective view of the screw portion of the tool of FIG. 5.

FIG. 5A shows a length of screw-threaded rod 15 and a corresponding nut 17. In practice, two of the rods 15 and two of the nuts 17 are utilized after the cap is placed over aperture 4. Thus, the screw threads and the nuts are tightened into one of the two apertures 12 and 12', and one the two aperatures 14 and 14', thereby getting a lifting effect as the surface of the nut bears on the top surface of cap 9. In this manner, the screw threads act as a "jack" to loosen the rollers from the apertures as the roller is withdrawn out of the aperture and into the inner surface of cap 9. Having duplicate sets of apertures 12, 14 and 12', 14' ensures that the load bearing unit can always be extracted even if one of th apertures becomes botched or a threaded rod were to break inside the aperture.

Figure 6:
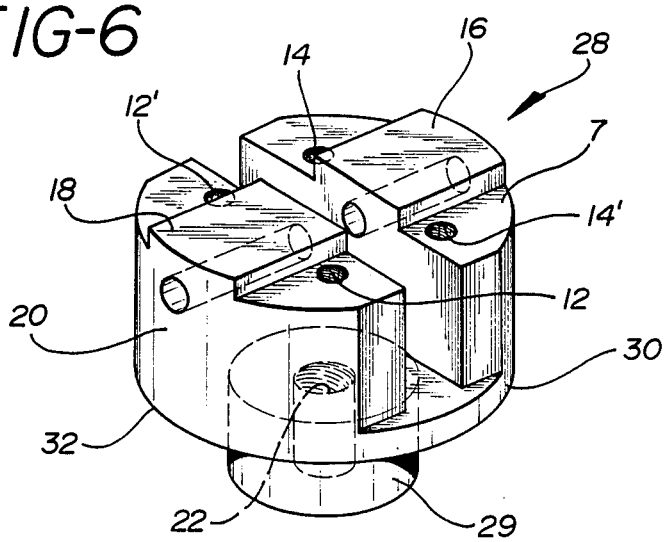
FIG. 6 is a perspective view of the axle support portion of the invention.

FIG. 6 is a perspective view of the axle support portion 28 of the load-bearing unit of the present invention. As shown in FIG. 6, portion 28 has two arms 7 and 20 for supporting axle 6. Portions 7 and 20 are mounted on reduced diameter portion 29, thereby forming a cylindrical shoulder surface 30, 32 for support of compression spring 9 (as shown in FIG. 4).

Screw threaded aperture 22 is formed in reduced diameter portion 29 for receiving assembly bolt 8 (FIG. 4).

Figure 7:
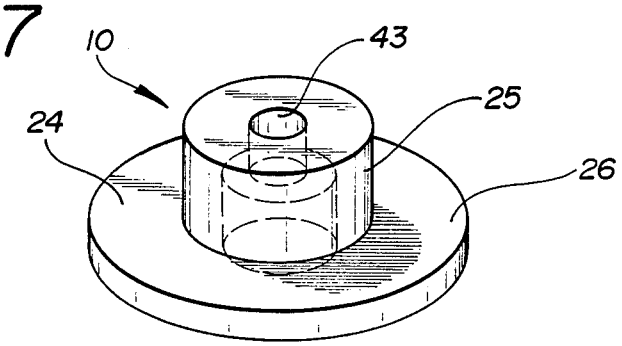
FIG. 7 is a perspective view of the bottom spring support of the invention.

FIG. 7 is a perspective view of the bottom portion 10 of the load-bearing unit. This portion forms a cylindrical surface 24, 26 for support of compression spring 9. Again, a reduced diameter cylinder 25 is formed on portion 10 to form the spring support surface 24, 26. Aperture 43 is formed in cylinder 25 to receive assembly bolt 8 (FIG. 4).

Figure 8:
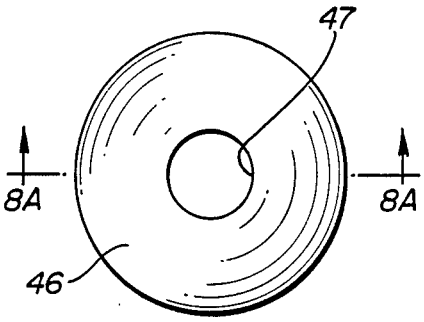
FIG. 8 is a top plan view of the dished seal of the invention.
Figure 8A:
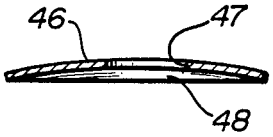
FIG. 8A is a cross section of the seal taken along line 8A—8A of FIG. 8.

FIGS. 8 and 8A are views of the TEFLON seal. The seals are circular disks with a body portion 46 that is at least partially curved to provide a volume 48 beneath the surface of the disk 46 in the shape of a dish. The seal has an aperture 47 thereon to overfit axle 6.

Figure 9:
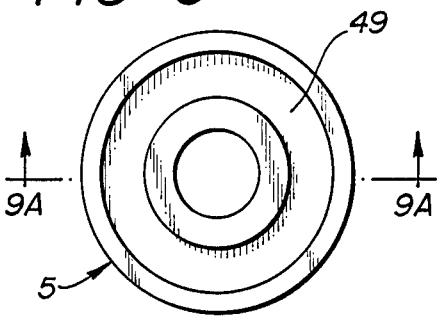
FIG. 9 is a top view of the grooved roller wheel of the invention.
Figure 9A:
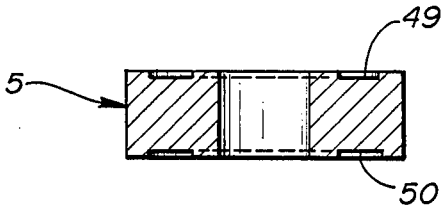
FIG. 9A is a cross section taken along line 9A—9A of FIG. 9.
Figure 10:
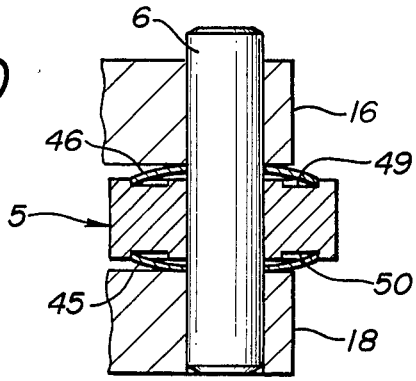
FIG. 10 is a side view, partially in section, showing the dished sealing disks mounted in the grooves of the wheels.
Figure 11:
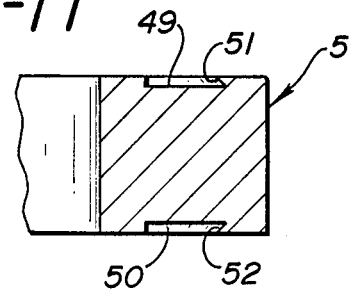
FIG. 11 shows a portion of the groove with an undercut wall.

FIGS. 9, 9A and 11 show the grooved roller wheel 5 which has grooves 49 and 50 cut in respective sides of the wheel. As shown in FIG. 10, the outer circumference of the seal disks are seated in and are supported by the walls of grooves 49 and 50.

FIG. 11 shows that the grooves 49 and 50 can be formed with undercuts 51 and 52 as the disk supporting walls of grooves 49 and 50, respectively.

Figure 12:
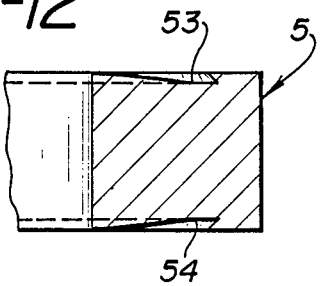
FIG. 12 shows a portion of the groove with an undercut wall and with a curved inner surface conforming to the shape of the seal.

Additionally, as shown in FIG. 12, the grooves 49, 50 can have a curved radially inner surface 53, 54 in addition to the undercut radially outer surface.

The curved radially inner surface follows the curvature of the sealing disks 45, 46 and thereby supports the sealing disk and prevents them from being unduly deflected.

The sealing disks 46, 47 tend to seal the axle 6 and the contact points on roller 5 as shown in FIG. 10. Additionally, the TEFLON surface of the seal provides a nonporous, relatively nonadhering surface so that sticky items which may tend to fall into the roller assembly will not adhere to the seal itself. Additionally, because the TEFLON has a "slippery" characteristic, it provides for a relatively easier rotation between either the roller or the axle mount 16, 18.

From the above description, it can be seen that this invention accomplishes many purposes. The main and most apparent of these are as follows:

(a) It makes it very easy to move the heavy molds normally associated with molding processes into and out of the press, thereby reducing operator fatigue;

(b) The apparatus is self-aligning to keep the rollers properly aligned so that the mold will move into the proper location in the press;

(c) The equipment has means for keeping dirt and other grit associated with the molding process out of the axle holes so that the rollers will not seize or otherwise stick or jam;

(d) The invention reduces wear and tear on the molds because of the ease with which they move into and out of the press; and (e) Additionally, it reduces wear and tear on the platens of the press.

The present invention being thus described, it will be obvious that same may be varied in many ways. Such variations are not to be regarded as a departure from the spirit and scope of the present invention, and all such modifications, as would be obvious to one skilled in the art are intended to be included within the scope of the following claims.

What is claimed is:

1. A mold-supporting arrangement for a press comprising:

a press platen having a plurality of spaced seating holes formed in an upper surface thereof, said seating holes being generally cylindrical in shape and having a hemispherical portion formed therein along the wall of said cylinder;

a plurality of load-bearing units seated in a selected number of said seating holes, each of said load-bearing units including a roller mounted on an axle, said axle extending across the entire diameter of said seating hole and into said hemispherical portion for limiting the rotation of said load-bearing unit in said aperture, said axle being supported by a unit body having an upper axle supporting portion and a lower bottom portion;

sealing means supported by the roller and connected to said axle for sealing a portion of the space between said axle and said upper axle supporting portion;

a compression spring coupled between said upper and lower portions; and means connecting said upper and lower portions for compressing said spring.

2. The support of claim 1, wherein said axle support include screw-threaded apertures drilled therein for assisting in removing said unit.

3. A roller assembly for a molding press said assembly permitting the mold to be easily moved over the roller to its desired location comprising:

a platen having a plurality of cylindrical apertures formed therein, each of said cylindrical apertures including a hemispherical aperture portion formed along a portion of said cylindrical aperature;

a roller, an axle supporting said roller;

an upper axle support having first and second arms for supporting the axle therebetween, said axle extending beyond said arms into a portion of said hemispherical aperture;

first and second compression seals coupled around said axle and mounted on said roller between said first and second arms and said roller;

a lower support;

a compression spring connected between said upper and lower supports; and a bolt connecting said upper and lower supports and adjusting the compression of said spring.

4. The assembly of claim 3 wherein each of said upper axle supports and said lower support includes a cylindrical section having a relatively small diameter and a spring support surface having a diameter larger than the diameter of said cylindrical section.

5. A mold-supporting arrangement for a press comprising:

a platen having a plurality of spaced seating holes formed in an upper surface thereof;

said seating holes each having an axle retaining portion formed therein along the wall thereof;

a plurality of load-bearing units seated in a selected number of said seating holes;

each of said load-bearing units including a roller mounted on an axle;

sealing means mounted to said roller to protect said roller from dirt and grease;

said axle extending across the entire diameter of said seating hole into said axle retaining portion for limiting the rotation of said load-bearing unit in said seating hole.

6. The mold-supporting arrangement of claim 5 wherein said seal includes a dished flexible circular disk member interfit with disk mating and supporting portions on said roller.

7. A roller assembly for a molding press, said assembly permitting the mold to be easily moved over the roller to its desired location comprising:

a platen having a plurality of apertures formed therein, each of said apertures further including an enlarged portion formed along a part of the interior thereof;

a roller, an axle supporting said roller;

an upper axle support having first and second arms for supporting the axle and roller therebetween;

dished flexible sealing means coupled between said arms and said roller;

said axle extending beyond said arms into said enlarged portion;

a lower support;

a compression spring connected between upper and lower supports; and a bolt connecting said upper and lower supports for adjusting the compression of said spring.

* * * * *